US010829928B2

(12) United States Patent
Houston et al.

(10) Patent No.: US 10,829,928 B2
(45) Date of Patent: Nov. 10, 2020

(54) FLOOR PLATE ASSEMBLY SYSTEM AND METHOD OF CONSTRUCTING A BUILDING THEREWITH

(71) Applicant: BIG TIME INVESTMENT, LLC, Southfield, MI (US)

(72) Inventors: Stephen T. Houston, Lake Orion, MI (US); Marisa V. Varga, Farmington, MI (US); Joseph Michael Benvenuto, Monroe, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 0 days.

(21) Appl. No.: 16/369,791

(22) Filed: Mar. 29, 2019

(65) Prior Publication Data

US 2020/0308822 A1 Oct. 1, 2020

(51) Int. Cl.
*E04B 1/35* (2006.01)

(52) U.S. Cl.
CPC ..... *E04B 1/3516* (2013.01); *E04B 1/3511* (2013.01); *E04B 2001/3588* (2013.01); *E04B 2103/02* (2013.01)

(58) Field of Classification Search
CPC ..... E04B 1/3516; E04B 1/3511; E04B 2001/3588; E04B 2103/02
See application file for complete search history.

(56) References Cited

U.S. PATENT DOCUMENTS 2,715,013 A * 8/1955 Slick ..... E04B 1/3511 254/106
3,040,411 A * 6/1962 Messenger ..... E04B 1/0007 405/229
3,052,449 A * 9/1962 Long ..... E04B 1/3511 254/89 R
3,053,015 A 9/1962 Graham
3,283,465 A 11/1966 Cheskin
3,692,446 A 9/1972 Vanderklaauw
3,831,902 A 8/1974 Vanderklaauw
3,978,630 A 9/1976 Labie et al.
(Continued)

FOREIGN PATENT DOCUMENTS

KR 100687607 B1 2/2007

OTHER PUBLICATIONS

International search report and Written Opinion for international application No. PCT/US2020/023647, dated Jun. 2, 2020.

*Primary Examiner* — Rodney Mintz
(74) *Attorney, Agent, or Firm* — Quinn IP Law

(57) ABSTRACT

A floor plate assembly system for a top-down construction process includes an assembly pad formed around a vertical support core of the building. The assembly pad includes a top surface disposed at a ground level elevation of the building, and covers a footprint of the building. A plurality of tie-downs are attached to the assembly pad. A plurality of jack pedestals is positioned on the assembly pad, and are operable to support the floor plate, and raise and lower the floor plate relative to the assembly pad. Camber may be introduced into selective frame members by restraining the frame member to the tie-downs and extending a respective jack pedestal. The floor plates may be raised in their entirety to a work height with the jack pedestals to allow workers easy access to an underside of the plate.

21 Claims, 8 Drawing Sheets

(56) References Cited

U.S. PATENT DOCUMENTS 4,071,988 A 2/1978 Bowes
4,206,162 A * 6/1980 Vanderklaauw ..... E04B 1/3511 264/33
4,251,974 A * 2/1981 Vanderklaauw ..... E04B 1/3511 254/89 H
4,455,270 A * 6/1984 O'Cadiz Castaneda ..... E04B 1/3511 264/33
5,460,499 A * 10/1995 Franklin ..... E04B 1/3516 249/20
5,469,684 A * 11/1995 Franklin ..... E04B 1/3516 264/33
5,528,877 A * 6/1996 Franklin ..... E04B 1/3516 264/33
5,654,015 A * 8/1997 Franklin ..... E04B 1/3516 249/20
6,082,058 A * 7/2000 Deng ..... E04B 1/3511 52/125.1
7,784,231 B2 8/2010 Termohlen
8,544,238 B2 * 10/2013 Larouche ..... E04B 1/3527 52/745.2
8,745,956 B2 * 6/2014 Wang ..... E04G 21/16 52/122.1
8,863,474 B2 * 10/2014 Yuan ..... E04B 1/35 52/122.1
9,145,285 B1 * 9/2015 Finfrock ..... E04B 5/04
9,752,316 B2 9/2017 Thornton
10,094,101 B1 * 10/2018 Jazzar ..... E04G 11/38
10,260,224 B1 * 4/2019 Jazzar ..... E04B 1/164
10,704,253 B1 * 7/2020 Houston ..... E04B 1/3511
10,745,903 B1 * 8/2020 Houston ..... E04B 1/5825
10,745,906 B1 * 8/2020 Houston ..... E04B 1/3516
10,745,919 B1 * 8/2020 Houston ..... E04F 11/066
10,753,080 B1 * 8/2020 Houston ..... E04B 1/3511
2008/0276550 A1 * 11/2008 Termohlen ..... E04B 1/3516 52/169.9
2009/0049762 A1 2/2009 Termohlen
2011/0289862 A1 * 12/2011 Larouche ..... E04G 13/02 52/122.1
2012/0023840 A1 * 2/2012 Yuan ..... B66F 7/20 52/122.1
2014/0017059 A1 * 1/2014 Wang ..... E04G 21/142 414/815
2017/0089062 A1 * 3/2017 Thornton ..... E04B 1/24
2017/0226702 A1 * 8/2017 Connell ..... B66C 1/666
2020/0284026 A1 * 9/2020 Houston ..... E04B 1/3516

* cited by examiner

FLOOR PLATE ASSEMBLY SYSTEM AND METHOD OF CONSTRUCTING A BUILDING THEREWITH

TECHNICAL FIELD

The disclosure generally relates to a floor plate assembly system for assembling a floor plate of a building, and a method of constructing a building therewith.

BACKGROUND

Many methods of constructing multi-story buildings exist. Traditionally, multi-story buildings have been constructed from the ground up, in which construction of the building begins on a ground level by attaching higher elevation structural elements on top of previously assembled lower structural elements to construct the building in upward direction, i.e., from bottom up. This construction method requires that the structural elements be lifted by a crane and connected in situ at elevation. This is particularly time intensive and costly when constructing tall buildings.

A more recent construction method includes constructing a vertical support core of the building. The vertical support core is designed to carry all structural loads of the building. The floor plates, including the roof, are constructed around the base of the vertical support core at ground level, lifted vertically into place, and then connected to the vertical support core. In this matter, the roof structure is assembled at ground level, lifted to its final elevation, and attached to the vertical support core. After the roof is attached to the vertical support core, the top floor plate is assembled at ground level, lifted to its final elevation, and attached to the vertical support core. Subsequent floor plates are assembled and attached to the vertical support core in the same manner in a descending order. By so doing, the roof and the floor plates of the building are constructed in a downward direction, i.e., from top down.

SUMMARY

A floor plate assembly system is provided. The floor plate assembly system is used for assembling a plurality of floor plates of a building around a vertical support core of the building, for a top-down construction process in which the plurality of floor plates are assembled, raised, and attached to the vertical support core sequentially in a descending order. The floor plate assembly system includes an assembly pad formed from a hardenable material. The assembly pad is formed around the vertical support core of the building. The assembly pad includes a top surface disposed at a ground level elevation of the building, and covers a footprint of the building. A plurality of tie-downs are attached to the assembly pad. The tie-downs are operable to provide a restraining force against upward vertical movement relative to the assembly pad. A plurality of jack pedestals is positioned on the assembly pad. The jack pedestals are operable to support the floor plate, and raise and lower the floor plate relative to the assembly pad.

In one aspect of the floor plate assembly system, a system controller is disposed in communication with each of the plurality of jack pedestals. The system controller is operable to precisely control extension and contraction of each respective one of the plurality of jack pedestals. By so doing, a camber may be formed into a frame member of a floor plate in situ. In order to introduce camber into a frame member, the frame member is restrained with the tie-downs against vertical movement relative to the assembly pad. The frame member is restrained in at least two locations along a length of the frame member. A respective one of the plurality of jack pedestals is controlled by the system controller to extend a distance to impart required deflections at the connections, and introduce a controlled amount of camber into the frame member in situ relative to the floor plate.

In another aspect of the floor plate assembly system, the plurality of jack pedestals is operable to raise the floor plates from the frame assembly elevation to an underside utility construction elevation. The underside utility construction elevation is sufficient to provide at least a minimum pre-defined clear distance between the floor plates and the ground elevation of the assembly pad. In one exemplary embodiment, the minimum pre-defined clear distance is equal to eight feet. However, the minimum pre-defined clear distance may be greater or less than the exemplary eight feet. With the floor plate positioned at the underside utility construction elevation, workers may easily access the underside of the floor plate to install utilities thereto, without having to bend over or crawl underneath the floor plate.

In another aspect of the floor plate assembly system, a delivery landing is positioned at a landing elevation adjacent to the assembly pad. The landing elevation is lower than the ground elevation of the assembly pad, such that a delivery surface of a delivery vehicle is positioned at the ground elevation of the assembly pad when the delivery vehicle is positioned on the delivery landing. A delivery on-ramp leads onto the delivery landing from a roadway. The delivery on-ramp includes a grade that transitions from a road elevation of the roadway to the landing elevation of the delivery landing. A delivery off-ramp leads off of the delivery landing to the roadway. The delivery off-ramp includes a grade that transitions from the landing elevation of the delivery landing to a road elevation of the roadway. Because the delivery surface of the delivery vehicle, e.g., a bed of a flatbed truck, is positioned at the ground elevation of the assembly pad, equipment and supplies may be easily loaded onto and off of the delivery vehicles.

A method of constructing a building is also provided. The method includes constructing a vertical support core of the building. The vertical support core is operable to carry all structural loads of the building. An assembly pad is poured from a hardenable material around the vertical support core. The assembly pad has a finished top surface disposed at a ground elevation of the building, and covers a footprint of the building. A pedestal system is positioned on the assembly pad. The pedestal system includes a plurality of jack pedestals, a plurality of fixed pedestals, and a plurality of moveable pedestals, all of which are positioned a desired locations on the assembly pad. A plurality of frame members are positioned around a periphery of the vertical support core, on the jack pedestals, the fixed pedestals, and the moveable pedestals. The pedestal system supports the frame members relative to each other at a frame assembly elevation. The frame assembly elevation is a desirable elevation for workers to comfortably attach the frame members to each other, e.g., at waist level. Each of the frame members is attached together at the frame assembly elevation to form a first floor plate. The first floor plate is then raised to an underside utility construction elevation with the plurality of jack pedestals. The first floor plate is supported by the plurality of jack pedestals when in the underside utility construction elevation. The underside utility construction elevation includes an elevation above the top surface of the assembly pad sufficient to provide a pre-defined minimum clear distance between the plurality of frame members and the top surface of the assembly pad. Utility systems may then be attached to an underside of the first floor plate, while the first floor plate is at the underside utility construction elevation. The first floor plate may then be raised to a first floor finished elevation relative to the vertical support core, with a lifting device. The first floor plate is then attached to the vertical support core at the first floor finished elevation. Subsequent floor plates are assembled on the pedestal system, raised to the underside utility construction height to install the utility systems, and then raised to the respective finished elevations and secured to the vertical support core in a descending sequential order.

In one embodiment of the method of constructing the building, a plurality of tie-downs is attached to the assembly pad. A respective one of the plurality of frame members of the first floor plate may be secured to the plurality of tie-downs at two locations, separated by a distance along a length of the respective frame member. A pedestal jack is disposed under the frame member. Camber may be introduced into the frame member with one or more of the pedestal jacks by extending the pedestal jacks to impart required deflections at the connections of the frame's members to the appropriate degree. Notably, the camber may be introduced into the frame member after the plurality of frame members have been arranged on the pedestal system, and/or attached together.

The above features and advantages and other features and advantages of the present teachings are readily apparent from the following detailed description of the best modes for carrying out the teachings when taken in connection with the accompanying drawings.

DETAILED DESCRIPTION

Figure 1:
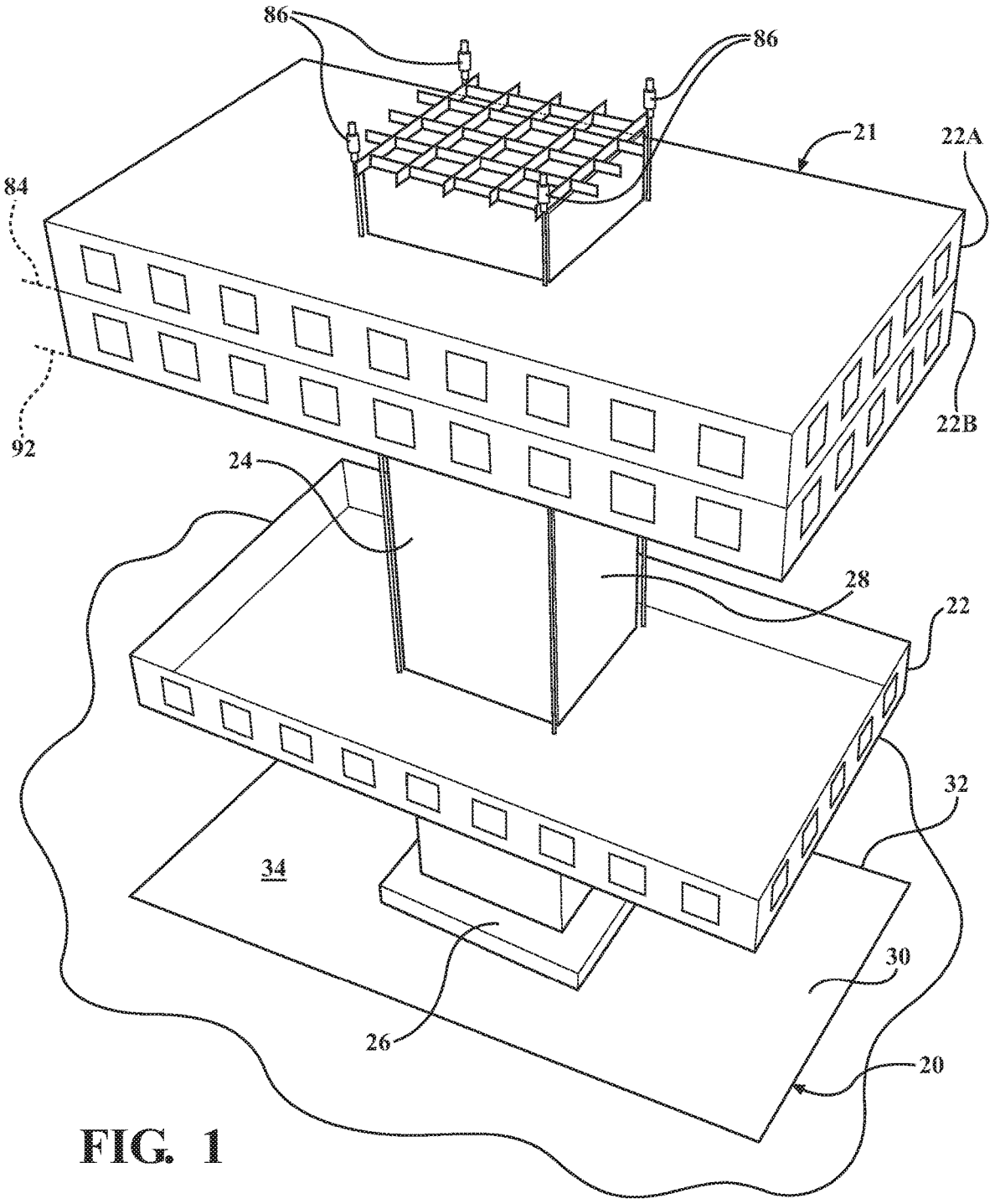
FIG. 1 is a schematic perspective view of a building partially constructed, and a floor plate assembly system.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, a floor plate assembly system is generally shown at 20. The floor plate assembly system 20 is used for assembling a plurality of floor plates 22 for a building 21, generally shown in FIG. 1. As used herein, with reference to FIGS. 2 and 3, the term "plate" includes all structural members, e.g., joists and/or purlins, flooring 76, e.g., concrete floor, interior walls 80, exterior curtain walls 78, modular room subassemblies, e.g., a lavatory module 82, utilities 94, etc., that form a floor or level of the building. The term "floor plate 22" may include a plate for a roof of the building, as well as a plate for a floor or level of the building. Accordingly, it should be appreciated that the term "floor plate 22" is used herein to refer to both a roof structure for the roof of the building, as well as a floor structure for a floor or level of the building.

Referring to FIG. 1, each of the floor plates 22 is attached to a vertical support core 24 of the building, using a top-down construction process, in which the floor plates 22 are assembled at ground level, raised to a finished elevation on the vertical support core 24, and then attached to the vertical support core 24. The floor plates 22 are assembled, raised, and attached to the vertical support core 24 sequentially in a descending order, i.e., top-down.

The vertical support core 24 is designed to carry all of the loads of the building. As such, the vertical support core 24 transfers the vertical load from each floor plate 22 to a foundation 26 of the vertical support core 24, which supports the building on the soil. The foundation 26 of the vertical support core 24 may be constructed in a manner suitable for the specific soil, weather, and seismic conditions of the building site. Additionally, the foundation 26 and the vertical support core 24 are designed to carry any bending moments introduced into the building, such as from a wind load or a seismic load. The specific type and construction of the foundation 26 of the vertical support core 24 is not pertinent to the teachings of this disclosure, are well known to those skilled in the art, and are therefore not described in detail.

The vertical support care may be constructed using a vertical slip form system that forms a wall 28 of the vertical support core 24 from a hardenable material, while moving vertically upward from a ground elevation 30 to a finished top elevation. The hardenable material may include, but is not limited to, a concrete mixture or other similar composition. The wall 28 of the vertical support core 24 may include reinforcing steel as understood in the art. The specific design and construction of the vertical support core 24 using the vertical slip form system are known to those skilled in the art, are dependent upon the specific application and location, are not pertinent to the teachings of this disclosure, and are therefore not described in detail herein.

Figure 2:
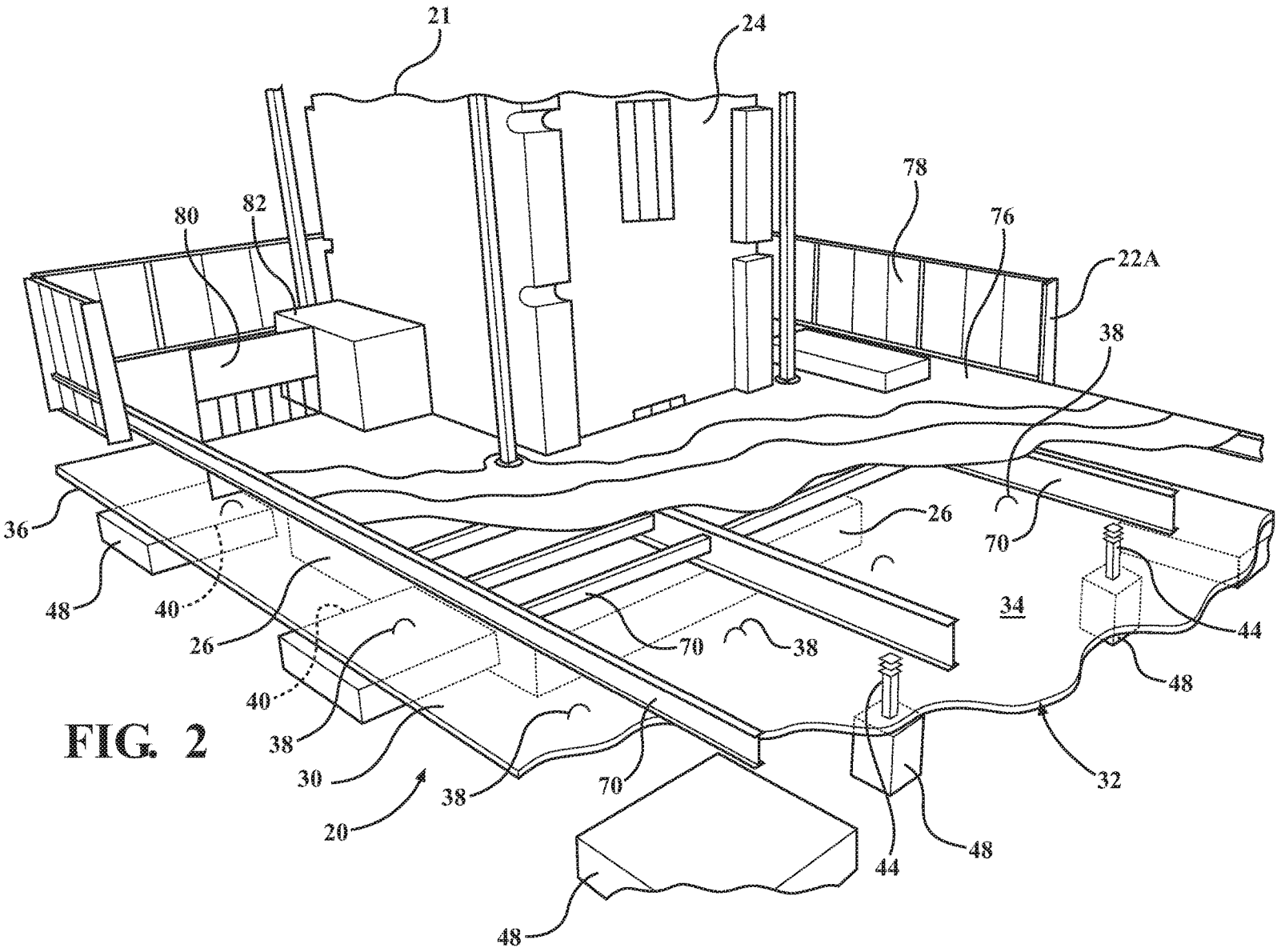
FIG. 2 is a schematic fragmentary perspective view of the building showing a floor plate thereof on the floor plate assembly system.
Figure 4:
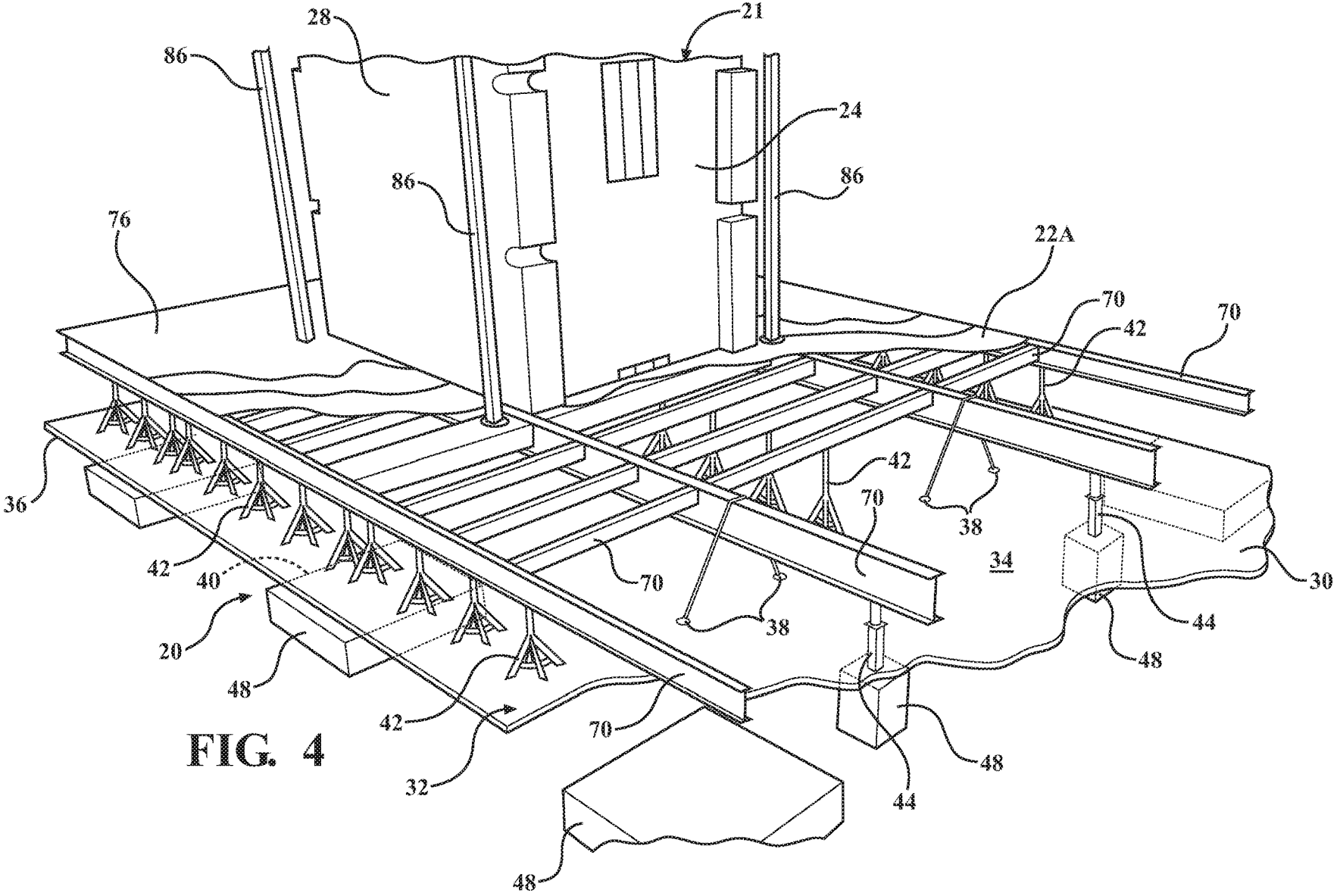
FIG. 4 is a schematic fragmentary perspective view of the building showing a floor plate thereof on the floor plate assembly system.

Referring to FIGS. 2 and 4, the floor plate assembly system 20 provides a workplace for assembling each of the floor plates 22 of the building. The floor plate assembly system 20 includes an assembly pad 32. The assembly pad 32 is formed from a hardenable material, around a periphery of the vertical support core 24 of the building. The assembly pad 32 includes a top surface 34 disposed at a ground level elevation of the building, and covers a footprint 36 of the building. The hardenable material may include, but is not limited to, concrete or a concrete mixture. The concrete mixture may include one or more additives as is known in the art. Additionally, the assembly pad 32 may include reinforcing members, e.g., steel reinforcing bars and/or a steel wire mesh as known in the art. In one exemplary embodiment, the assembly pad 32 includes a nominal thickness equal to four inches. However, in other embodiments, the thickness of the assembly pad 32 may be more or less than the exemplary embodiment of four inches.

As noted above, the top surface 34 of the assembly pad 32 is disposed at the ground elevation 30 of the building. It should be appreciated that the soil subsurface may need to be spread, leveled, and compacted prior to pouring the assembly pad 32. Additionally, it should be appreciated that the thickness of the assembly pad 32 may vary due to variations of the soil elevation below the assembly pad 32, but that the top surface 34 of the assembly pad 32 is constructed to be substantially horizontal or flat. It should be appreciated that the top surface 34 of the assembly pad 32 may vary form horizontal and/or flat within standard construction tolerances.

A plurality of tie-downs 38 may be attached to the assembly pad 32. The tie-downs 38 are operable to provide a restraining force against upward vertical movement relative to the assembly pad 32. In one embodiment, each tie-down 38 may include, for example, a metal strap or ring that includes a portion embedded in the assembly pad 32 during the pouring of the assembly pad 32, such that a loop is formed above the top surface 34 of the assembly pad 32. A chain, cable, or strap may be attached to the tie-down 38. In other embodiments, each of the tie-downs 38 may be attached to the assembly pad 32 after the assembly pad 32 has cured, such as with mechanical fasteners and/or an adhesive. The tie-downs 38 may be attached to the assembly pad 32 in some other manner not specifically mentioned or described herein.

In order to resist the upward vertical force that may be applied to the tie-downs 38, the location of each tie-down 38 on the assembly pad 32 may be modified to provide additional strength to the assembly pad 32 in the location of each tie-down 38. For example, in one embodiment, additional reinforcing steel may be added to the assembly pad 32 in a reinforcing zone 40 disposed around each tie-down 38 location. In another embodiment, a foundation 26, such as a block of concrete, may be added below the location of each tie-down 38, with each the tie-down 38 embedded in a respective foundation 26.

A pedestal system is arranged on the assembly pad 32. The pedestal system includes a plurality of pedestals arranged at specific locations to support the floor plates 22 during assembly. The pedestal system may include, but is not limited to, one or more moveable pedestals 42, one or more fixed pedestals 44, and one or more jack pedestals 46.

The moveable pedestals 42 may include, for example, a stand supporting an adjustment mechanism. As shown in the exemplary embodiment, the stand is shown as a tripod. However, it should be appreciated that the stand is not limited to the exemplary embodiment shown in the Figures. The moveable pedestals 42 are not secured to the assembly pad 32, and may be easily moved around the assembly pad 32 as needed. The adjustment mechanism may include, but is not limited to, a screw jack or other similar mechanism that is incorporated into each of the moveable pedestals 42 and allows for a limited amount of adjustment in the height of the moveable pedestal 42. For example, the moveable pedestals 42 may include two or three feet of adjustability. In other embodiments, the amount of vertical adjustment may be less than described herein.

Figure 5:
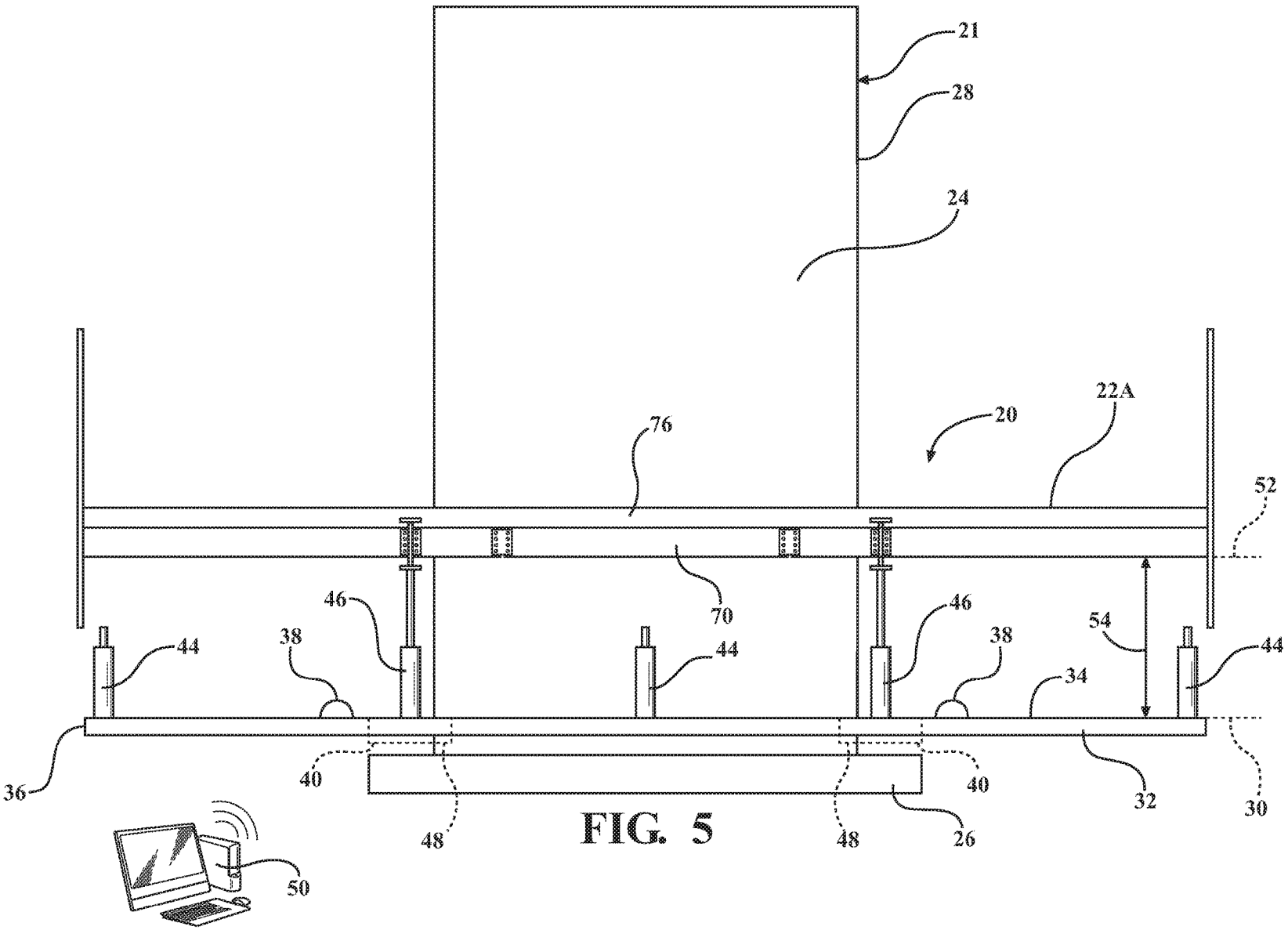
FIG. 5 is a schematic side view of the building showing a floor plate raised to an underside utility construction elevation.

Referring to FIGS. 4 and 5, the fixed pedestals 44 are fixed in place on the assembly pad 32. The fixed pedestals 44 include a base, and an adjustment mechanism. The position of the base is precisely located on the assembly pad 32 to provide support for the floor plates 22 at a location thereof. The base of the fixed pedestals 44 may be securely attached to the assembly pad 32 in a suitable manner, such as with mechanical fasteners. The assembly pad 32 may be reinforced in the area of each of the fixed pedestals 44 as needed. For example, the assembly pad 32 may include additional reinforcing steel at the locations of the fixed pedestals 44, or a pedestal foundation 48, e.g., a block of concrete, may be constructed below the assembly pad 32 in each location of the fixed pedestals 44. Generally, the fixed pedestals 44 may be considered more robust or heavy duty than the moveable pedestals 42. As such, the base of each of the fixed pedestals 44 may be constructed from a heavier and/or stronger material than the stand of the moveable pedestals 42. The adjustment mechanism may include, but is not limited to, a screw jack or other similar mechanism that is incorporated into each of the fixed pedestals 44 and allows for a limited amount of adjustment in the height of the fixed pedestal 44. For example, the moveable pedestals 42 may include two or three feet of adjustability. In other embodiments, the amount of vertical adjustment may be less than described herein.

Like the fixed pedestals 44, the jack pedestals 46 may also be fixed in place on the assembly pad 32. However, unlike the fixed pedestals 44, the jack pedestals 46 are operable to raise the individual floor platforms to a height greater than the fixed pedestals 44 are capable of Additionally, each of the jack pedestals 46 may include a computer controlled hydraulic jack that is capable of precise movement and/or force control, described in greater detail below. The position of the jack pedestals 46 is precisely located on the assembly pad 32 to provide support for the floor plates 22 at a specific location thereof. The jack pedestals 46 may be securely attached to the assembly pad 32 in a suitable manner, such as with mechanical fasteners. The assembly pad 32 may be reinforced in the area of each of the jack pedestals 46 as needed. For example, the assembly pad 32 may include additional reinforcing steel at the locations of the jack pedestals 46, or a pedestal foundation 48, e.g., a block of concrete, may be constructed below the assembly pad 32 in each location of the jack pedestals 46. The assembly pad 32 is designed to support each of the jack pedestals 46 such that the plurality of jack pedestals 46 are operable to support each of the individual floor plates 22 without substantial settling. As used herein, "substantial settling" should be understood to include settling that is greater than industry allowable construction tolerances.

Referring to FIG. 5, the jack pedestals 46 may be controlled to raise and/or lower the individual floor plates 22 relative to the assembly pad 32. The jack pedestals 46, or a subset of the jack pedestals 46, are operable to raise each of the individual floor plates 22 to an underside utility construction elevation 52. The underside utility construction elevation 52 is an elevation of the individual floor plates 22 above the top surface 34 of the assembly pad 32 that is sufficient to provide at least a minimum pre-defined clear distance 54 between each of the individual floor plates 22 and the top surface 34 of the assembly pad 32, i.e., the ground elevation 30 of the assembly pad 32. In one exemplary embodiment, the pre-defined clear distance 54 is approximately equal to eight feet. However, in other embodiments, the pre-defined clear distance 54 may be more or less than the exemplary eight feet described herein.

As noted above, each of the jack pedestals 46 may include a computer controlled hydraulic jack. A computer, i.e., a system controller 50, may be connected to and in communication with each of the jack pedestals 46. The system controller 50 includes specialized software that is capable of precisely controlling the each of the jack pedestals 46, either individually or in combination with each other. As such, the system controller 50 is operable to precisely control extension and contraction of each respective one of the plurality of jack pedestals 46. In addition to raising the individual floor plates 22 to the underside utility construction elevation 52, the jack pedestals 46 may be used to introduce camber (described in greater detail below) into one or more of the frame members 70 of the floor plates 22 in situ on the pedestal system.

The floor plate assembly system 20 may further include a delivery landing 56. The delivery landing 56 is positioned at a landing elevation 58A, 58B. In one embodiment, shown in FIG. 6, the landing elevation 58A is lower than the ground elevation 30 of the assembly pad 32, such that a delivery surface 60 of a delivery vehicle 62, e.g., a deck of a flatbed trailer, is positioned at the ground elevation 30 of the assembly pad 32, when the delivery vehicle 62 is positioned or parked on the delivery landing 56. In this manner, the delivery vehicle 62 may be easily loaded and/or unloaded with equipment operating on the top surface 34 of the assembly pad 32, i.e., the ground elevation 30. In another embodiment, shown in FIG. 7, the landing elevation 58B is higher than the ground elevation 30 of the assembly pad 32, such that a delivery surface 60 of a delivery vehicle 62, e.g., a deck of a flatbed trailer, is positioned at an upper surface elevation of the individual floor plates 22, when the delivery vehicle 62 is positioned or parked on the delivery landing 56. In this manner, the delivery vehicle 62 may be easily loaded and/or unloaded with equipment operating on the upper surface elevation of a floor plate 22.

Figure 6:
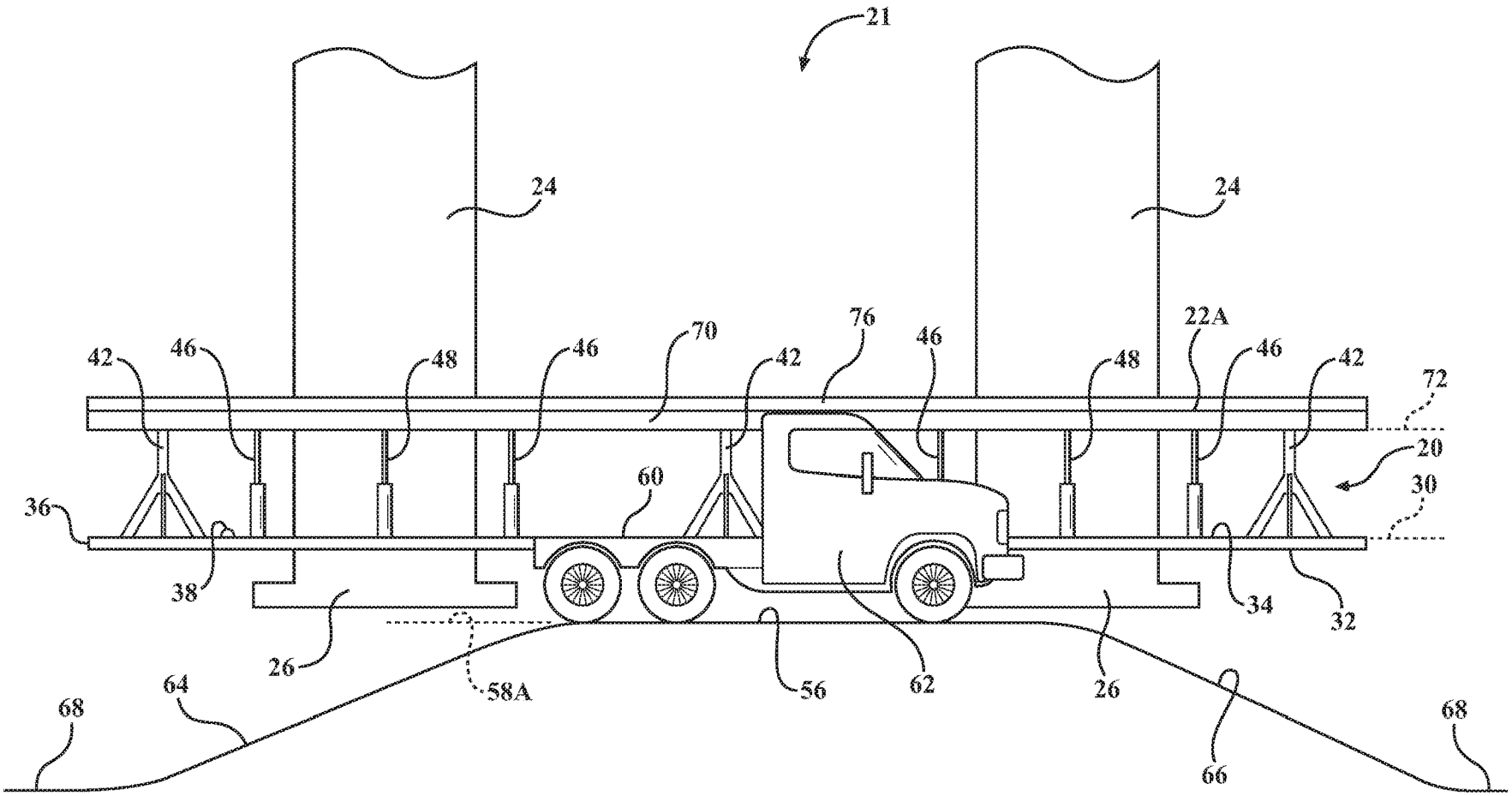
FIG. 6 is a schematic side view of the floor plate assembly system showing a first embodiment of a delivery landing.
Figure 7:
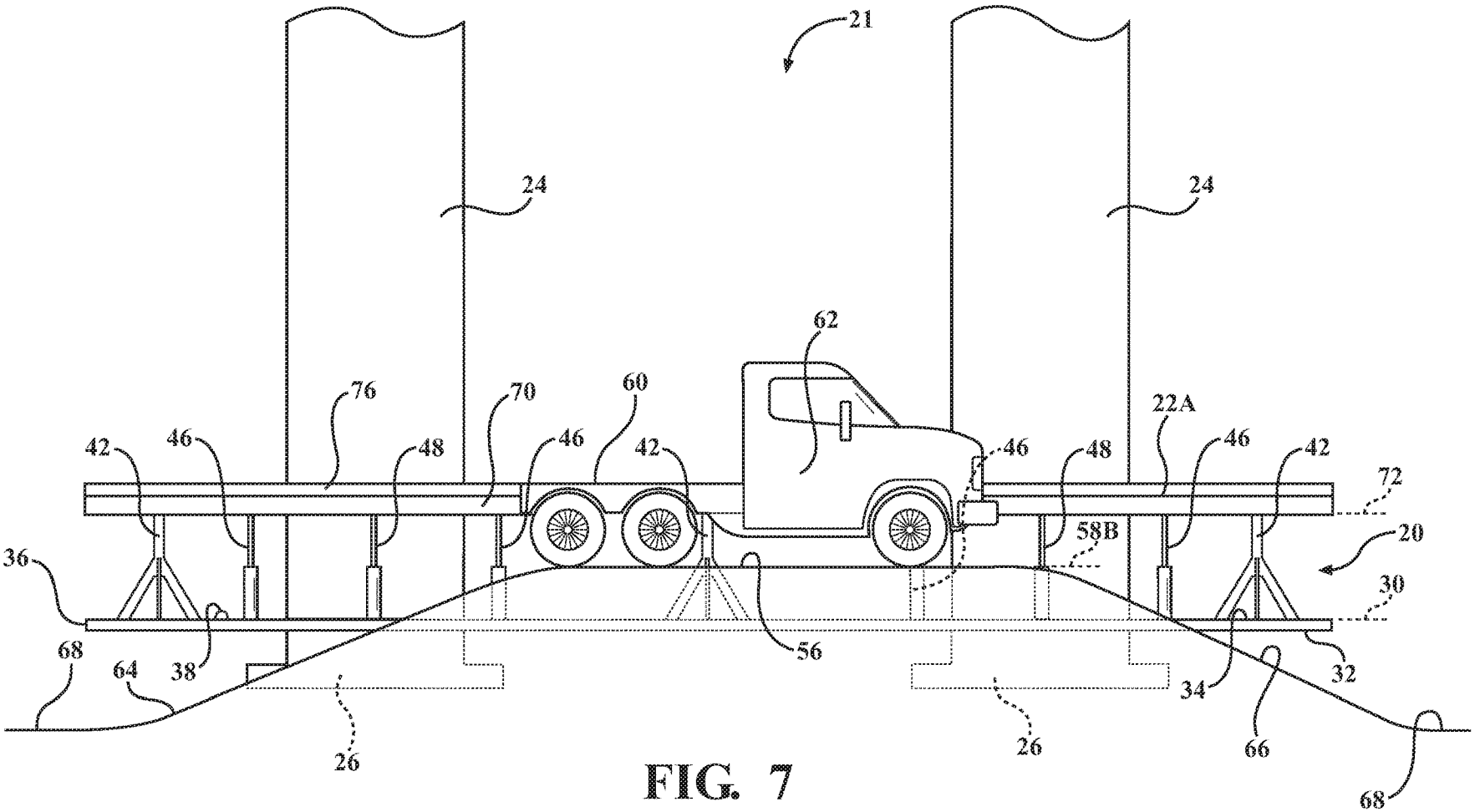
FIG. 7 is a schematic side view of the floor plate assembly system showing a second embodiment of the delivery landing.

As shown in both FIGS. 6 and 7, a delivery on-ramp 64 leads from a roadway elevation 68 onto the delivery landing 56. The delivery on-ramp 64 includes a longitudinal grade that transitions from the roadway elevation 68 to the landing elevation 58A, 58B of the delivery landing 56. A delivery off-ramp 66 leads off of the delivery landing 56 to the roadway elevation 68. The delivery off-ramp 66 includes a longitudinal grade that transitions from the landing elevation 58A, 58B of the delivery landing 56 to the roadway elevation 68.

A method of constructing the building using the floor plate assembly system 20 is also provided. The method includes the foundation 26 of the vertical support core 24, followed by constructing the vertical support core 24 on top of its foundation 26. As described above, the vertical support core 24 is constructed to carry all of the structural loads of the building. The vertical support core 24 may be constructed in any suitable manner. For example, as described above, the vertical support core 24 may be constructed using a vertical slip form system, as understood by those skilled in the art.

Once the vertical support core 24 is constructed, the floor plate assembly system 20 may be prepared. If necessary, one or more pedestal foundations 48 may be constructed to support a respective pedestal, such as one of the fixed pedestals 44 or one of the jack pedestals 46. The pedestal foundation 48 may be constructed in a suitable manner, such as but not limited to burying a cardboard form in the ground, and filling the form with concrete. Pedestal foundations 48 are constructed in precise locations to correspond to specific load locations of the floor plates 22. The specific number and location of the pedestal foundations 48 is dependent upon the application and design of the building.

Once the pedestal foundations 48 are constructed, the assembly pad 32 may be constructed around the vertical support core 24. As described above, the assembly pad 32 is constructed from a hardenable material, such as but not limited to concrete. The assembly pad 32 may be poured to any desired thickness. For example, the assembly pad 32 may be poured to include a nominal thickness of four inches. However, in other embodiments, the thickness of the assembly pad 32 may be greater or less than the exemplary four inches described herein. Additionally, construction of the assembly pad 32 may include placing reinforcing members in the hardenable material as it is poured. As noted above, additional reinforcing members may be placed at locations of the assembly pad 32 for the tie-downs 38 and/or to support the pedestal system. The type and manner in which the reinforcing steel is placed in the assembly pad 32 is known to those skilled in the art, and is not described in detail herein.

The tie-downs 38 are attached to the assembly pad 32. In one embodiment, the tie-downs 38 are embedded in the hardenable material of the assembly pad 32 as the assembly pad 32 is poured. In another embodiment, the tie-downs 38 are attached to the assembly pad 32 with mechanical fasteners and/or an adhesive after the assembly pad 32 has hardened. It should be appreciated that the tie-downs 38 may be attached to the assembly pad 32 in some other manner not specifically mentioned or described herein.

The pedestals of the pedestal system may then be positioning on the assembly pad 32. As described above, the pedestal system may include one or more of the jack pedestals 46, the fixed pedestals 44, and/or the moveable pedestals 42. If any fixed pedestals 44 are used, then the fixed pedestals 44 may be attached to the assembly pad 32 at their desired locations. Similarly, the jack pedestals 46 are attached to the assembly pad 32 at their respective locations. It should be appreciated that the locations on the assembly pad 32 for each fixed pedestal 44 and each jack pedestal 46 are precisely defined to correspond with exact support points for the individual floor plates 22. As described above, each of the fixed pedestals 44 and each of the jack pedestals 46 may be positioned over a respective pedestal foundation 48. As noted above, the moveable pedestals 42 are easily moveable. As such, the moveable pedestals 42 may be positioned on the assembly pad 32 as needed.

As best shown in FIG. 4, once the pedestals are positioned on the assembly pad 32, a plurality of frame members 70 for a respective floor plate 22 are arranged around a periphery of the vertical support core 24, on the pedestals. The pedestal system supports the frame members 70 relative to each other at a frame assembly elevation 72. The adjusting mechanisms of each respective moveable pedestal 42 and each respective fixed pedestal 44 may be adjusted to precisely position the frame members 70 at the frame assembly elevation 72. Additionally, the jack pedestals 46 may be controlled with the system controller 50 to position the frame members 70 at the frame assembly elevation 72.

The frame members 70 may include, but are not limited to, structural steel members, such as I-beams, channels, etc., which form the structural support system for the respective floor plate 22. The frame members 70 are attached together to form the respective floor plate 22, hereinafter referred to as the first floor plate 22A. While the detailed description describes the assembly of the first floor plate 22A and a second floor plate 22B subsequent thereto, it should be appreciated that the description of the first floor plate 22A and the second floor plate 22B is exemplary, and applies to any of the floor plates 22 of the building.

The frame members 70 may be attached together in any suitable manner, including but not limited to bolted connections, welded connections, etc. The specific ways in which the frame members 70 may be attached together are known to those skilled in the art, are not pertinent to the teachings of this disclosure, and are therefore not described in detail herein.

Figure 8:
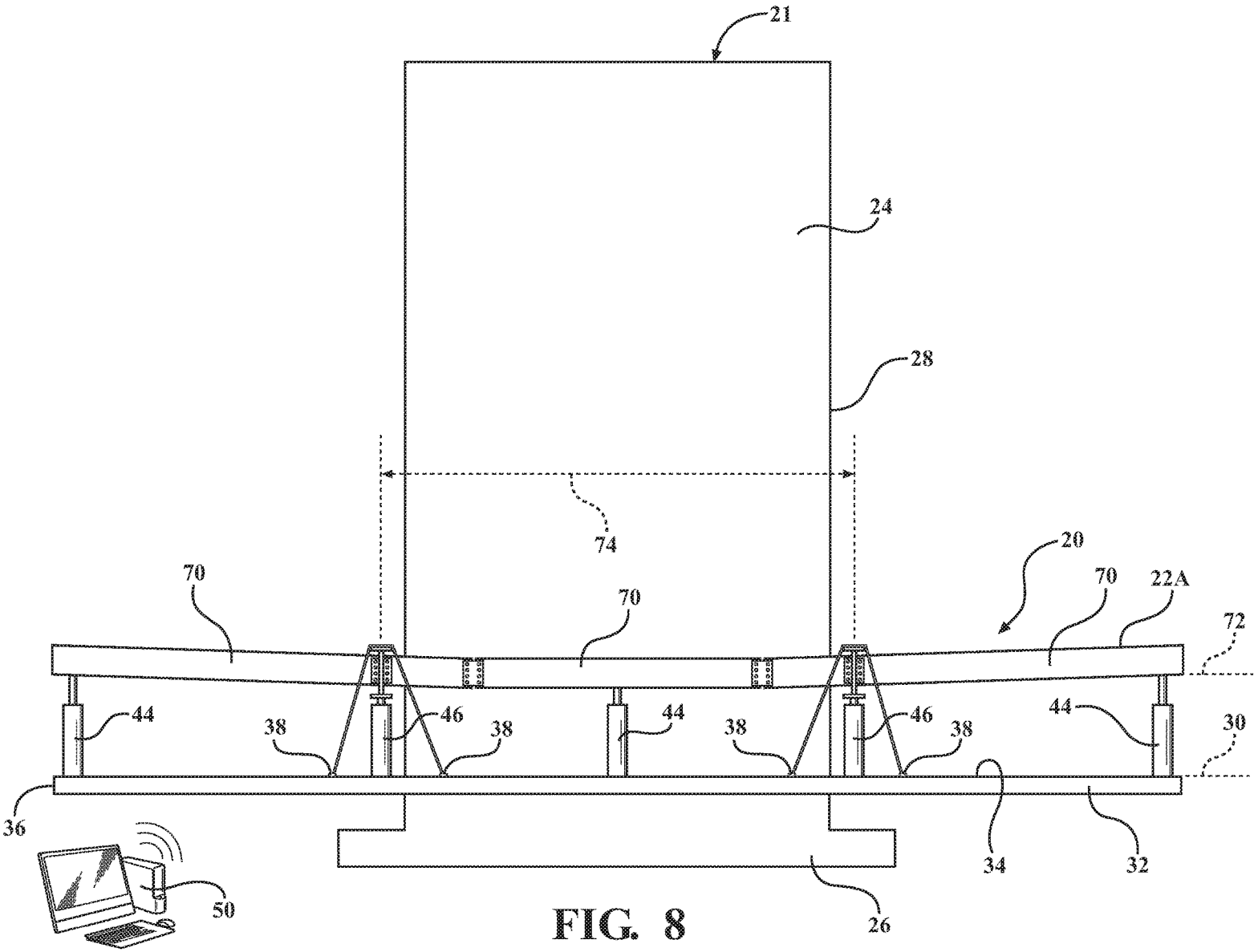
FIG. 8 is a schematic side view of the floor plate assembly system being used to introduce camber into a floor member.

In one aspect of the method of constructing the building, the floor plate assembly system 20 may be used to introduce camber into one of the frame members 70, and/or to impart required deflections at one or more connections connecting adjacent frame members 70. In order to do so, with reference to FIG. 8, one of the frame members 70 of the first floor plate 22A may be secured to the tie-downs 38 in at least two locations. The two locations are separated by a distance 74 along a length of the respective frame member 70. One or more of the fixed pedestals 44 and/or the jack pedestals 46 is disposed under the frame members 70. The fixed pedestals 44 and/or the jack pedestals 46 may be precisely controlled by the system controller 50 to extend a required distance to impart the necessary camber into the frame member 70, and/or to impart the required deflection at a connection between frame members 70, such as shown in FIG. 8. Notably, the camber and/or the joint deflection may be introduced into the frame member 70 when the frame member 70 is arranged on the pedestals and attached to the other frame members 70. Accordingly, if a frame member 70 is delivered on-site with the improper camber, the camber can be adjusted on-site using the floor plate assembly system 20.

Referring to FIG. 2, once the frame members 70 are attached together to form the first floor plate 22A, the flooring 76 may be applied to the frame members 70. The flooring 76 may include, but is not limited to, a concrete floor. However, the flooring 76 may include some other material not mentioned or described herein. The concrete floor is poured on top of the frame members 70. The process of pouring the concrete floor is known to those skilled in the art, is not pertinent to the teachings of this disclosure, and is therefore not described in detail herein. In addition to the floor, other items may be attached to the floor plate 22. For example, exterior curtain walls 78 and interior walls 80 may be attached to the floor plate 22, lavatory modules 82 may be positioned on the floor plate 22, etc. Preferably, all construction work for each individual floor plate 22, or as much as possible, is performed while the floor plate 22 is at the frame assembly elevation 72 and/or the underside utility construction elevation 52.

As shown in FIG. 5, in order to install some of the components of the first floor plate 22A, the first floor plate 22A may be raised to the underside utility construction elevation 52 with the jack pedestals 46. The entirety of the first floor plate 22A is supported by the jack pedestals 46, or a subset of the jack pedestals 46, when positioned in the underside utility construction elevation 52. As noted above, the underside utility construction elevation 52 includes an elevation above the top surface 34 of the assembly pad 32 that is sufficient to provide the pre-defined minimum clear distance 54 between the plurality of frame members 70 and the top surface 34 of the assembly pad 32. This enables workers to work underneath the first floor plate 22A at a comfortable work height, and/or move equipment around underneath the first floor plate 22A.

Figure 3:
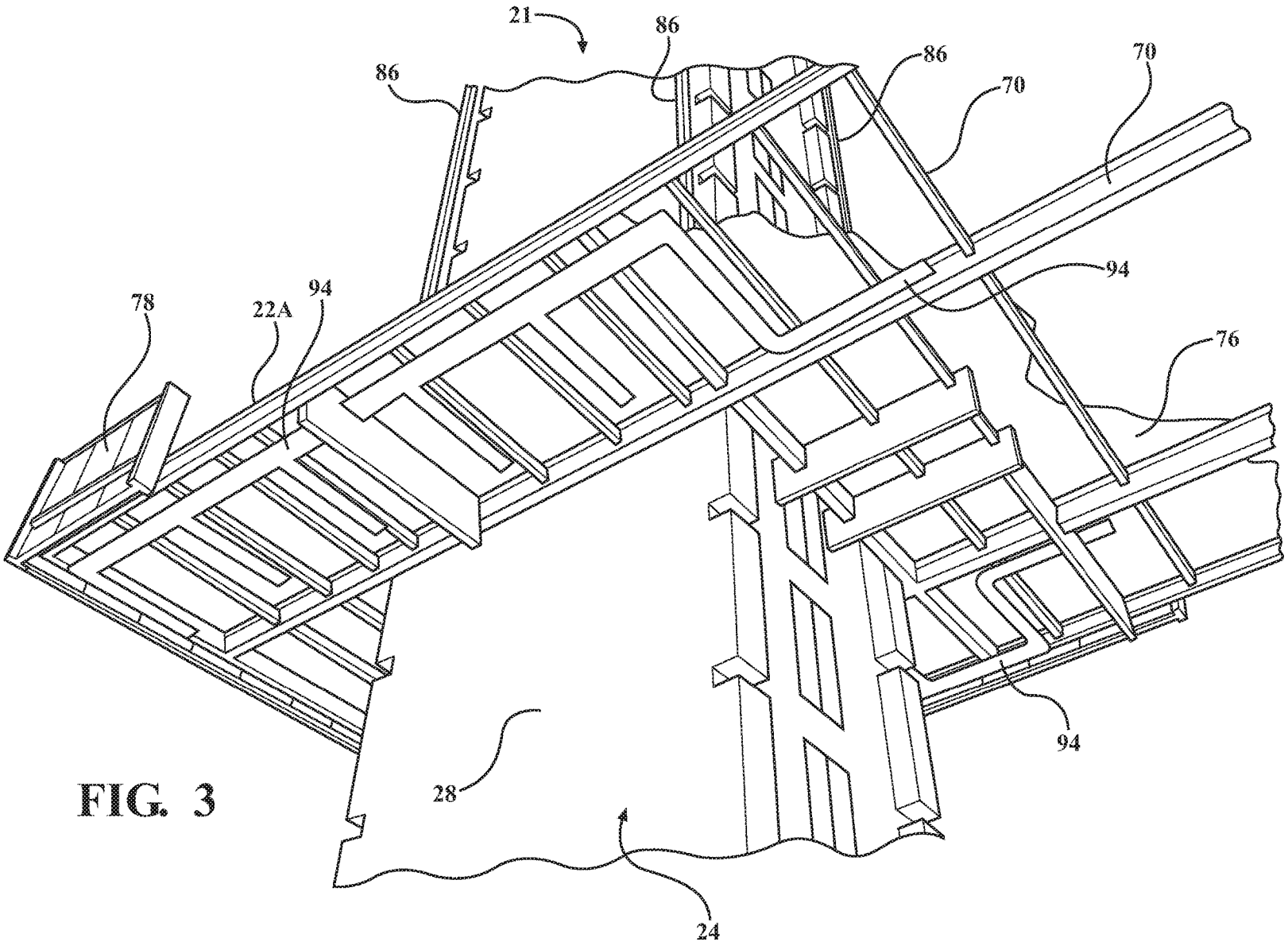
FIG. 3 is a schematic fragmentary perspective view of the building showing a floor plate partially raised into position.

Once all components of the first floor plate 22A have been attached thereto, either at the frame assembly elevation 72 or at the underside utility construction elevation 52, the first floor plate 22A is raised to a first floor finished elevation 84 relative to the vertical support core 24. FIG. 3 shows the first floor plate 22A partially raised relative to the vertical support core. FIG. 1 shows the first floor plate 22A in the first floor finished elevation 84. The first floor plate 22A is raised with a lifting device 86, shown in FIG. 1. The lifting device 86 may include, but is not limited to, one or more strand jacks. The process of raising the first floor plate 22A relative to the vertical support core 24 is known to those skilled in the art, is not pertinent to the teachings of this disclosure, and is therefore not described in detail herein.

The first floor plate 22A is then attached to the vertical support core 24 at the first floor finished elevation 84. The first floor plate 22A may be attached to the vertical support core 24 in any suitable manner. The specific manner in which the first floor plate 22A is attached to the vertical support core 24 is not pertinent to the teachings of this disclosure are known to those skilled in the art, and are therefore not described in detail herein.

The process described above for the first floor plate 22A may then be repeated with a subsequent floor plate 22, e.g., a second floor plate 22B. Accordingly, a second group of frame members 70 may be arranged around the periphery of the vertical support core 24 on the pedestals, after the first floor plate 22A has been secured to the vertical support core 24 at the first floor finished elevation 84. Each of the second group of frame members 70 may be attached together to form the second floor plate 22B. The second floor plate 22B may be raised to the underside utility construction elevation 52 with the jack pedestals 46, and utility systems may be attached to an underside of the second floor plate 22B. The second floor plate 22B may then be raised to a second floor finished elevation 92 relative to the vertical support core 24 with the lifting device 86, and attached to the vertical support core 24 at the second floor finished elevation 92, shown in FIG. 1.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A floor plate assembly system for assembling a plurality of floor plates of a building around a vertical support core of the building for a top-down construction process in which the plurality of floor plates are assembled, raised, and attached to the vertical support core sequentially in a descending order, the floor plate assembly system comprising:

an assembly pad composed of a hardenable material, the assembly pad positioned around a periphery of the vertical support core of the building, wherein the assembly pad includes a top surface disposed at a ground level elevation of the building, and covers a footprint of the building;

a plurality of tie-downs attached to the assembly pad and configured to provide a restraining force against upward vertical movement of a respective said floor plate located above the assembly pad;

a plurality of jack pedestals positioned on the assembly pad and configured to support each of the floor plates, and raise and lower each of the floor plates relative to the assembly pad; and a delivery landing positioned immediately adjacent to the assembly pad at a landing elevation;

wherein the landing elevation is lower than the ground level elevation of the assembly pad such that a delivery surface of a delivery vehicle is positioned at the ground level elevation of the assembly pad when the delivery vehicle is positioned on the delivery landing.

2. The floor plate assembly system set forth in claim 1, wherein the landing elevation is higher than the ground level elevation of the assembly pad such that a delivery surface of a delivery vehicle is positioned at an upper surface elevation of a respective one of the floor plates when the delivery vehicle is positioned on the delivery landing.

3. The floor plate assembly system set forth in claim 1, further comprising a delivery on-ramp leading onto the delivery landing from a roadway, wherein the delivery on-ramp includes a grade transitioning from a road elevation of the roadway to the landing elevation of the delivery landing.

4. The floor plate assembly system set forth in claim 1, further comprising a delivery off-ramp leading off of the delivery landing to a roadway, wherein the delivery off-ramp includes a grade transitioning from the landing elevation of the delivery landing to a road elevation of the roadway.

5. A floor plate assembly system for assembling a plurality of floor plates of a building around a vertical support core of the building for a top-down construction process in which the plurality of floor plates are assembled, raised, and attached to the vertical support core sequentially in a descending order, the floor plate assembly system comprising:

an assembly pad composed of a hardenable material, the assembly pad positioned around a periphery of the vertical support core of the building, wherein the assembly pad includes a top surface disposed at a ground level elevation of the building, and covers a footprint of the building;

a plurality of tie-downs attached to the assembly pad and configured to provide a restraining force against upward vertical movement of a respective said floor plate located above the assembly pad;

a plurality of jack pedestals positioned on the assembly pad and configured to support each of the floor plates, and raise and lower each of the floor plates relative to the assembly pad; and a system controller in communication with each of the plurality of jack pedestals;

wherein the system controller is operable to precisely control extension and contraction of each respective one of the plurality of jack pedestals, such that a camber is configured to be formed into one or more frame members of a respective one of the plurality of floor plates in situ by restraining a respective one of the frame members against vertical movement relative to the assembly pad at two locations along a length of the respective frame member with the plurality of tie-downs, and controlling a respective one of the plurality of jack pedestals to extend a distance to bend the respective frame member and introduce a controlled amount of camber into the respective frame member in situ relative to the respective one of the plurality of floor plates.

6. The floor plate assembly system set forth in claim 5, wherein each of the plurality of jack pedestals is a hydraulic jack.

7. The floor plate assembly system set forth in claim 5, wherein each of the plurality of jack pedestals includes a foundation disposed under the assembly pad, such that the plurality of jack pedestals are operable to support each of the floor plates without substantial settling.

8. The floor plate assembly system set forth in claim 5, wherein the hardenable material is concrete, the assembly pad having a nominal thickness equal to four inches.

9. The floor plate assembly system set forth in claim 5, wherein each of the plurality of tie-downs includes a reinforcing zone of the assembly pad, with each respective one of the plurality of tie-downs attached to the assembly pad within a respective said reinforcing zone.

10. The floor plate assembly system set forth in claim 5, further comprising at least one moveable pedestal supported on the assembly pad.

11. The floor plate assembly system set forth in claim 5, further comprising at least one fixed pedestal supported on the assembly pad.

12. The floor plate assembly system set forth in claim 5, wherein the plurality of jack pedestals is operable to raise each of the floor plates to an underside utility construction elevation sufficient to provide at least a pre-defined minimum clear distance between the respective floor plate and the ground level elevation of the assembly pad.

13. The floor plate assembly system set forth in claim 12, wherein the minimum pre-defined minimum clear distance is equal to eight feet.

14. A method of constructing a building, the method comprising:

constructing a vertical support core of the building, wherein the vertical support core is operable to carry all structural loads of the building;

pouring an assembly pad around the vertical support core from a hardenable material, wherein the assembly pad has a finished top surface disposed at a ground level elevation of the building, and covers a footprint of the building;

positioning a pedestal system on the assembly pad, wherein the pedestal system includes a plurality of jack pedestals, a plurality of fixed pedestals, and a plurality of moveable pedestals;

arranging a plurality of frame members around a periphery of the vertical support core on the plurality of jack pedestals, the plurality of fixed pedestals, and the plurality of moveable pedestals, wherein the pedestal system supports the plurality of frame members relative to each other at a frame assembly elevation;

attaching each of the plurality of frame members together to form a first floor plate;

raising the first floor plate to an underside utility construction elevation with the plurality of jack pedestals, whereby the first floor plate is supported by the plurality of jack pedestals, and wherein the underside utility construction elevation includes an elevation above the top surface of the assembly pad sufficient to provide a pre-defined minimum clear distance between the plurality of frame members and the top surface of the assembly pad;

attaching utility systems to an underside of the first floor plate while the first floor plate is at the underside utility construction elevation;

raising the first floor plate to a first floor finished elevation relative to the vertical support core with a lifting device; and attaching the first floor plate to the vertical support core at the first floor finished elevation.

15. The method set forth in claim 14, further comprising:

arranging a second plurality of frame members around the periphery of the vertical support core on the plurality of jack pedestals, the plurality of fixed pedestals, and the plurality of moveable pedestals, after the first floor plate has been secured to the vertical support core at the first floor finished elevation, wherein the pedestal system supports the second plurality of frame members relative to each other at the frame assembly elevation;

attaching each of the second plurality of frame members together to form a second floor plate;

raising the second floor plate to the underside utility construction elevation with the plurality of jack pedestals, whereby the second floor plate is supported by the plurality of jack pedestals;

attaching utility systems to an underside of the second floor plate while the second floor plate is at the underside utility construction elevation;

raising the second floor plate to a second floor finished elevation relative to the vertical support core with the lifting device; and attaching the second floor plate to the vertical support core at the second floor finished elevation.

16. The method set forth in claim 14, wherein pouring the assembly pad includes pouring the assembly pad from concrete to include a nominal thickness equal to four inches.

17. The method set forth in claim 14, further comprising constructing a plurality of pedestal foundations at predetermined locations within the footprint of the building.

18. The method set forth in claim 17, further comprising attaching each of the jack pedestals to the assembly pad over a respective one of the pedestal foundations.

19. The method set forth in claim 14, further comprising attaching a plurality of tie-downs to the assembly pad.

20. The method set forth in claim 19, further comprising securing at least one of the plurality of frame members of the first floor plate to the plurality of tie-downs at two locations separated by a distance along a length of the at least one of the plurality of frame members, with a respective one of the plurality of jack pedestals disposed along the length of the at least one of the plurality of frame members.

21. The method set forth in claim 20, further comprising introducing a camber into the at least one of the plurality of frame members of the first floor plate with the respective one of the plurality of jack pedestals, after the plurality of frame members have been arranged on the pedestal system.

* * * * *